US008776441B1

(12) United States Patent
Lawrence

(10) Patent No.: US 8,776,441 B1
(45) **Date of Patent: *Jul. 15, 2014**

(54) WINDOW VENT LATCH SHEATH AND METHOD

(71) Applicant: Barry G. Lawrence, Thomasville, NC (US)

(72) Inventor: Barry G. Lawrence, Thomasville, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/669,524

(22) Filed: Nov. 6, 2012

(51) Int. Cl.
*E05C 17/44* (2006.01)

(52) U.S. Cl.
USPC ..... 49/449; 49/183; 49/186; 292/DIG. 47

(58) Field of Classification Search
USPC ..... 49/449, 183, 186; 292/338, 339, 292/341.18, DIG. 46, DIG. 47
See application file for complete search history.

(56) References Cited

U.S. PATENT DOCUMENTS

| | | | | |
|---|---|---|---|---|
| 1,261,274 | A * | 4/1918 | Brachter et al. | 292/63 |
| 4,054,308 | A * | 10/1977 | Prohaska | 292/204 |
| 5,553,903 | A * | 9/1996 | Prete et al. | 292/163 |
| 6,003,201 | A * | 12/1999 | Ryczek | 16/87 R |
| 6,834,464 | B2 * | 12/2004 | Shoemaker | 49/449 |
| 7,415,797 | B2 * | 8/2008 | Dotson et al. | 49/185 |
| 7,500,330 | B2 * | 3/2009 | Fullick | 49/185 |
| 8,007,017 | B2 * | 8/2011 | Farrell | 292/341.15 |
| 2010/0084877 | A1 * | 4/2010 | Gledhill et al. | 292/341.19 |
| 2012/0144752 | A1 * | 6/2012 | Piltingsrud | 49/450 |

* cited by examiner

*Primary Examiner* — Katherine Mitchell
*Assistant Examiner* — Abe Massad
(74) *Attorney, Agent, or Firm* — Blake P. Hurt

(57) ABSTRACT

A sheath for a window vent latch having a housing defining a slot sized to allow a vent latch to fit therein, and a spring attached to the housing for engaging the inside of a conventional window jamb. A method of seating a window vent latch in a window frame including the steps of providing a vent latch in a vent latch sheath having a housing and a spring, a window with a window frame having a window jamb, placing the vent latch sheath in the window jamb while allowing the spring to engage the window jamb, and adjusting the vent latch housing along the window jamb.

19 Claims, 4 Drawing Sheets

WINDOW VENT LATCH SHEATH AND METHOD

FIELD OF THE INVENTION

The invention herein pertains to vent latches and particularly pertains to a vent latch sheath with a spring for easy installation in a conventional window jamb.

DESCRIPTION OF THE PRIOR ART AND OBJECTIVES OF THE INVENTION

Vent latches have become an easy and efficient way to control the height a window sash can obtain within a window jamb. With an increased focus of safety regulations and forced entry requirements (FER), vent latches are an economical and effective way to incorporate windows, especially the double-hung style, into a new building. Whether the vent latch is positioned on the window sash or within the window jamb, any window sash below the latch will strike the extended bolt and have the ascension stopped. The vent latch may also be configured such that the sash above the latch strikes the bolt when attempting to lower the sash. This is a particularly useful feature when trying to limit access to open windows, for example in the presence of small children.

While vent latches have a variety of types and a wide range of applications, they are not particularly versatile. Once installed on the window sash or jamb, they cannot be moved unless the fasteners that secure the relatively small latch are removed. This tedious task must be performed when a different type of latch or a different latch location is desired. Vent latches are typically employed in pairs and often must be realigned and reinstalled. If not properly aligned, ineffective sash resistance and window damage may occur.

Thus, in view of the problems and disadvantages associated with prior vent latches, the present invention was conceived and one of its objectives is to provide a vent latch sheath for securing a vent latch in a conventional window jamb.

It is another objective of the present invention to provide a vent latch sheath with a spring for easy positioning up and down the window jamb.

It is still another objective of the present invention to provide a vent latch sheath with an aperture for receiving a fastener for securing the sheath to the window jamb.

It is yet another objective of the present invention to provide a vent latch sheath with a housing having a lip for engaging the window jamb opposite the spring.

It is a further objective of the present invention to provide a vent latch sheath with a housing that defines a slot for receiving a vent stop latch.

It is still a further objective of the present invention to provide a method for seating a vent latch sheath in a window jamb to anchor a vent stop latch to a window.

It is yet a further objective of the present invention to provide a method for aligning a pair of vent stop latches with the bottom sash of a window.

Various other objectives and advantages of the present invention will become apparent to those skilled in the art as a more detailed description is set forth below.

SUMMARY OF THE INVENTION

The aforesaid and other objectives are realized by providing a sheath for a window vent latch having a housing that defines a slot sized to allow a vent latch to fit therein. The sheath also includes a spring attached to the housing that engages the window jamb when the sheath is inserted into the window jamb.

A method of seating a window vent latch in a window frame is also included. The method includes the step of providing a vent latch in a vent latch housing with a spring, as well as a window frame including a window jamb. The method further includes the step of placing the vent latch housing in the window jamb while allowing the spring to engage the window jamb. The method also includes the step of adjusting the vent latch housing along the window jamb for proper window positioning.

DETAILED DESCRIPTION OF THE PREFERRED EMBODIMENT AND OPERATION OF THE INVENTION

Figure 1:
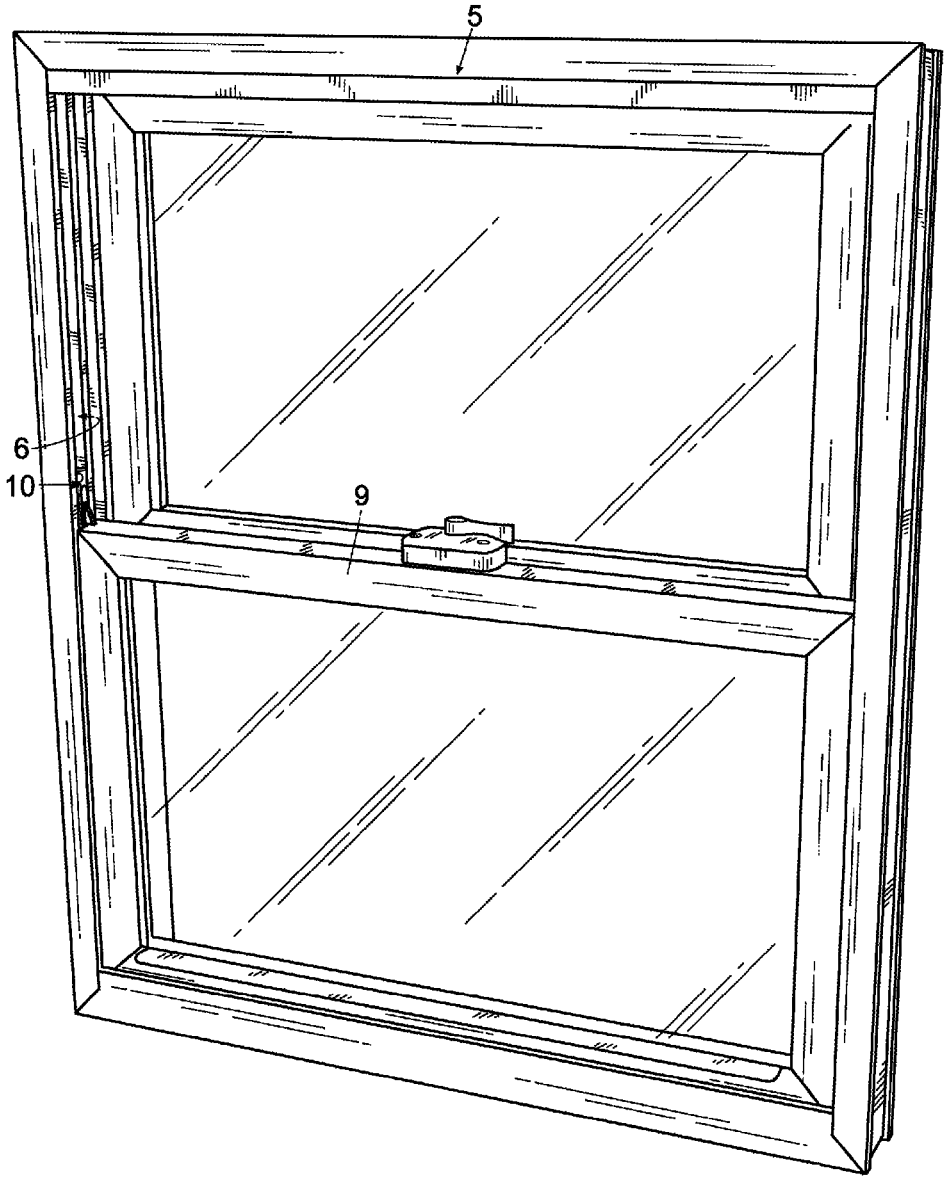
FIG. 1 illustrates a perspective view of a vent stop latch and a window vent latch sheath of the invention in a window.
Figure 2:
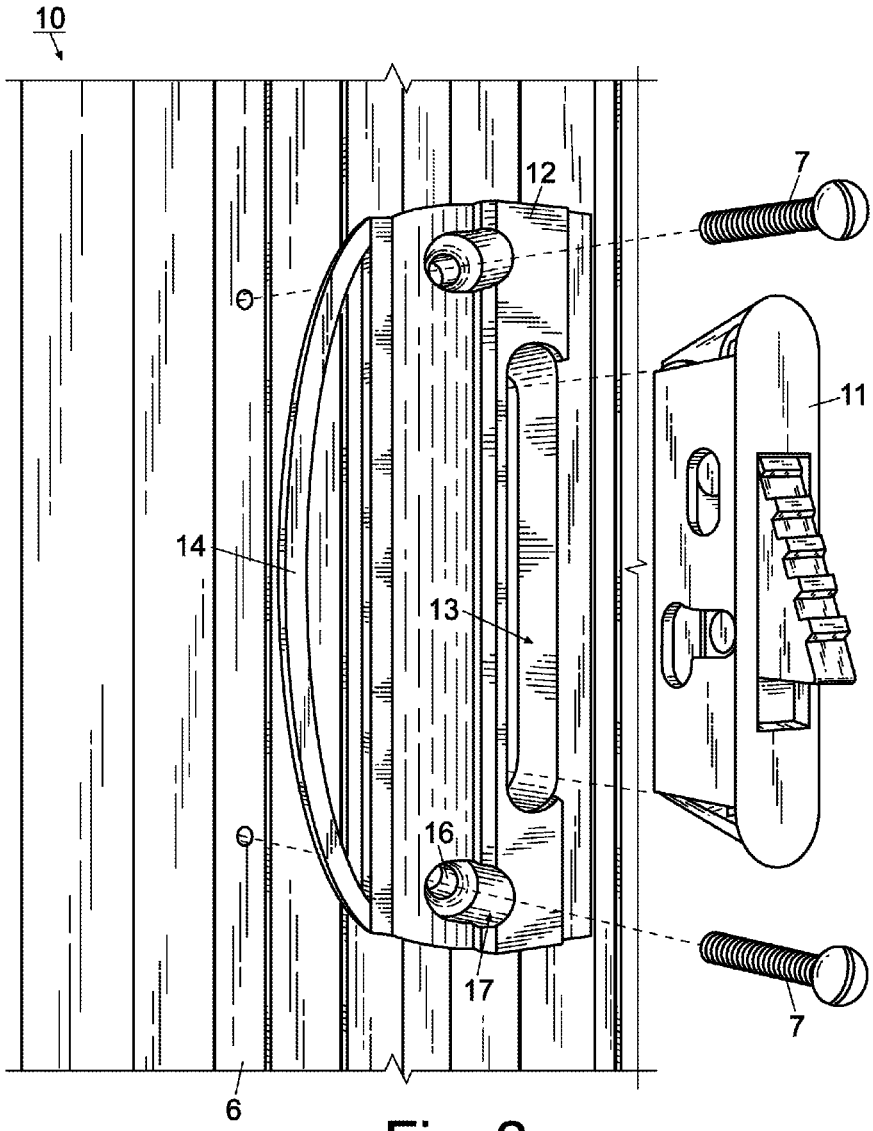
FIG. 2 shows an enlarged, exploded view of the vent latch sheath of FIG. 1 with a vent stop latch prior to positioning in a window jamb.

For a better understanding of the invention and its operation, turning now to the drawings, FIG. 1 illustrates a perspective view of window vent latch sheath 10 containing vent stop latch 11 therein and positioned and engaged within window jamb 6 of window frame 5. Preferred window vent latch sheath 10 is constructed from nylon but may also be formed out of other suitable materials such as a polymeric blend, metal, or wood. Vent latch sheath 10 is made up of housing 12 and U-shaped spring 14 as seen in FIG. 2. In an alternate embodiment (not shown), latch sheath 10 may also be integrally formed with vent stop latch 11 such that sheath 10 and latch 11 form one integrated unit. Housing 12 is sized to seat within conventional window jamb 6. Preferably, housing 12 is two and a half inches (2½") (6.35 centimeters) long, three quarters of an inch (¾") (1.91 centimeters) tall, and one half inch (½") (1.27 centimeters) wide, although it should be understood that vent latch sheath 10 may be any size to fit within window jamb 6 or similar conventional jambs.

Figure 3:
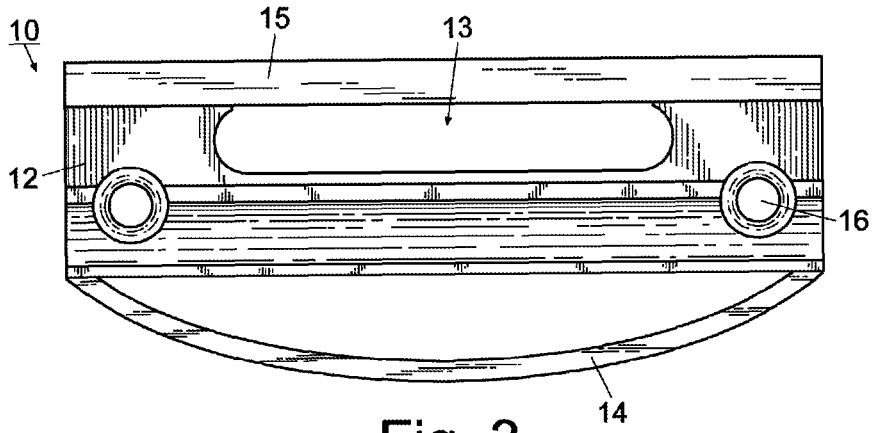
FIG. 3 depicts a top plan view of the vent latch sheath of FIG. 2.

FIG. 2 shows an exploded view of vent latch sheath 10 and vent stop latch 11 prior to placement within window jamb 6. Spring 14 is attached on one end to the base of housing 12 and extends outwardly in an arcuate arch before affixing again to the opposing end of housing 12. Spring 14 is preferably formed from the same nylon material as preferred housing 12 but it should be understood that spring 14 could be formed from any resilient material that can flex sufficiently to impart horizontal force on window jamb 6 to maintain vent latch sheath 10 in a desired position. FIG. 2 also demonstrates latch slot 13 formed in housing 12 and sized to receive vent stop latch 11. As would be understood, vent stop latch 11 may be any of a variety of conventional vent stop latches available in the industry and as such is not described herein. Preferably, latch slot 13 is elliptical in shape as seen in FIG. 3, however latch slot 13 could be formed in a variety of shapes to accommodate differently shaped vent stop latches as needed.

Figure 5:
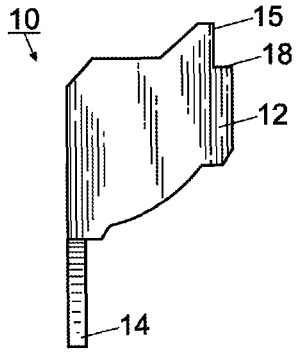
FIG. 5 demonstrates an elevated side view of the end of the vent latch sheath of FIG. 3, the opposing side end view being a mirror image thereof.

During insertion of latch sheath 10 into window frame 5, spring 14 extends outwardly to engage one side of window jamb 6. Spring 14 is compressed by manual pressure during insertion to deform spring 14 and allow housing 12 to be positioned within window jamb 6 and rotated slightly whereby sheath lip 15 as seen in FIG. 5 engages the side of window jamb 6 opposite spring 14. Once housing 12 is fully inserted, the pressure transferred from the flexing of spring 14 against housing 12 to lip 15 maintains sheath 10 within window jamb 6. This orientation affords vent latch sheath 10 the stability of two points of engagement with window jamb 6 while permitting vent latch sheath 10 the mobility to slide up and down within window frame 5 to obtain the desired position.

Sheath lip 15 is formed along the length of housing 12 opposite spring 14 and extends outwardly therefrom beneath shoulder 18 as seen in FIG. 5. Lip 15 has a rectangular top surface as seen in FIG. 3 and includes a series of supports 19 (FIG. 7) therebeneath which are integrally formed with lip 15 and housing 12 for added stability of lip 15.

When properly positioned, vent latch 11 supported within vent latch sheath 10 contacts window frame 5 to prevent undesired raising or lowering of sash 9 as seen in FIG. 1. To secure vent latch sheath 10 to window jamb 6, fasteners 7 are inserted through apertures 16 and secured to window frame 5. Preferably, a pair of circular apertures 16 are formed within housing recesses 17 and are sized to receive conventional fasteners 7, for example screws, which are inserted once the desired position of sheath 10 is obtained. However, in one or more alternate embodiments, fasteners 7 may be studs (not shown) sized to protrude approximately 1/16th of an inch (1.59 millimeters) from housing 12 and be received within recesses formed in window jamb 6. These studs may be a separate component of housing 12 or they may be formed integrally therewith. Further, one or more studs may be used to provide additional structural support for sheath 10 during use.

Recesses 17 allow fasteners 7 to be fully recessed within housing 12 to refrain from deterring the operation of vent stop latches 11 and movement of window sash 9 when stop latch 11 is disengaged. Fasteners 7 rigidly maintain sheath 10 in the desired position to prevent displacement of sheath 10. If sheath 10 and latch 11 are moved to a different position, fasteners 7 may be removed, housing 12 manually grasped and slid up or down within jamb 6 to the new position and fasteners 7 reinserted. As would be understood while only one side of window frame 5 is shown and described herein with sheath 10 and latch 11, an identical sheath and latch 11 would be opposingly installed at an identical position for proper use.

Figure 4:
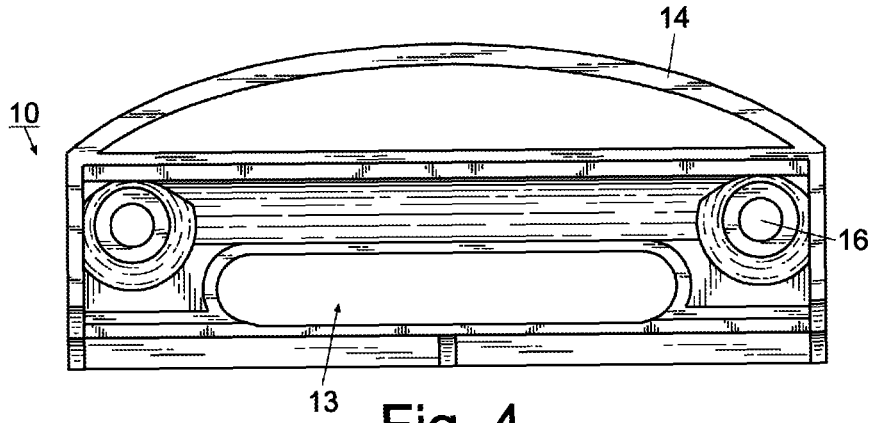
FIG. 4 displays a bottom plan view of the vent latch sheath of FIG. 3.
Figure 6:
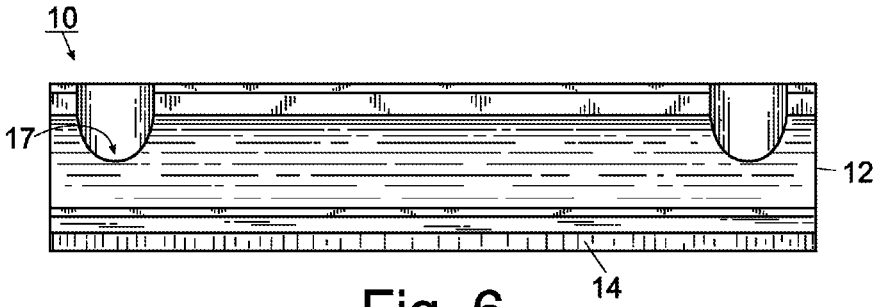
FIG. 6 illustrates an elevated front view of the vent latch sheath of FIG. 3.
Figure 7:
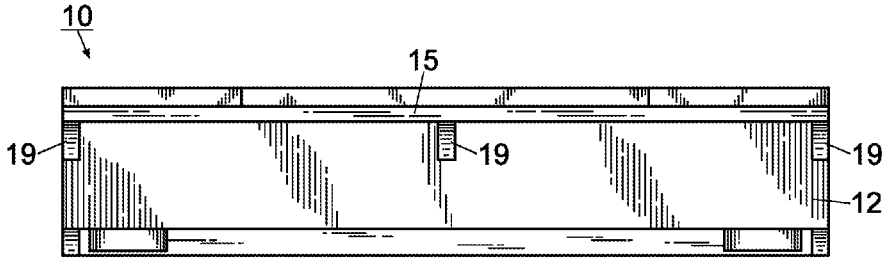
FIG. 7 shows an elevated rear view of the vent latch sheath of FIG. 3.

FIG. 4 depicts a bottom view of vent latch sheath 10 while FIG. 5 shows an elevational end view thereof. Although only one end of vent latch sheath 10 is shown and described, it is understood that the opposite end of sheath 10 is a mirror image and all descriptions apply equally. FIG. 6 demonstrates a front elevational view of sheath 10 somewhat showing the depth of recesses 17 in housing 12. FIG. 7 pictures a rear elevational view of sheath 10 showing lip 15 and supports 19 positioned therebeneath.

The preferred method for seating vent latch sheath 10 within window frame 5 includes the steps of providing vent stop latch 11 in vent latch sheath 10 having vent latch housing 12 and spring 14, as well as window frame 5 with window jamb 6, placing vent latch housing 12 in window jamb 6 while engaging spring 14 to one side of window jamb 6, and adjusting vent latch housing 12 along window jamb 6 for proper window positioning. The method also includes the steps of providing vent latch housing 12 with sheath lip 15 diagonally opposing spring 14, slightly rotating vent latch housing 12 to engage the opposing side of window jamb 6 with sheath lip 15, inserting and snap-fitting vent stop latch 11 into vent latch housing 12 via slot 13, and affixing housing 12 in window frame 5 with fastener 7. After vent stop latch 11 and vent latch sheath 10 are positioned, the method may further include the steps of installing a second vent stop latch 11 and vent latch sheath 10 in the opposing window jamb 6 (not shown) and aligning the pair of vent stop latches 11 by contacting them both simultaneously with window sash 9 for proper positioning prior to securing them with fasteners 7.

The illustrations and examples provided herein are for explanatory purposes and are not intended to limit the scope of the appended claims.

I claim:

1. A sheath for a window vent latch comprising: a housing, said housing defining a slot, said slot sized to allow a vent latch to fit therein, and a resilient U-shaped spring, a first end of said resilient spring attached to a first end of said housing and a second opposing end of said resilient spring attached to a second, longitudinally opposing end of said housing, wherein said U-shaped spring extends from said first end of said housing to said second, longitudinally opposing end of said housing and wherein a curvature of said U-shaped spring extends in a longitudinal direction such that a concavity of said U-shaped spring faces said housing.

2. The sheath of claim 1 wherein said housing is formed from a polymeric material.

3. The sheath of claim 1 wherein said spring is formed from a polymeric material.

4. The sheath of claim 1 wherein said slot is elliptical.

5. The sheath of claim 1 further comprising a lip, said lip affixed to said housing.

6. The sheath of claim 1 wherein said housing defines an aperture, said aperture sized to receive a fastener.

7. The sheath of claim 6 further comprising a recess, said recess located on said housing, said aperture positioned within said recess.

8. A sheath for a window vent latch comprising: a housing, a lip, said lip affixed to said housing, said housing defining an elliptical slot, said slot sized to allow a vent latch to fit therein, a U-shaped spring, a first end of said resilient spring attached to a first end of said housing and a second, longitudinally opposing end of said resilient spring attached to a second opposing end of said housing, a recess, said housing defining an aperture, said aperture positioned within said recess, wherein said U-shaped spring extends from said first end of said housing to said second, longitudinally opposing end of said housing.

9. The sheath of claim 8 wherein said housing is formed from a polymeric material.

10. The sheath of claim 9 wherein said spring is formed from a polymeric material.

11. The sheath of claim 10 wherein said aperture is sized to receive a fastener.

12. A method of seating a window vent latch in a window frame comprising the steps of:

a) providing the window vent latch sheath of claim 1 and a vent latch therein, and a window with a window jamb;

b) placing the vent latch sheath in the window jamb while allowing the spring to engage the window jamb; and c) adjusting the vent latch sheath along the window jamb.

13. The method of claim 12 wherein the step of providing the vent latch sheath further includes providing the vent latch housing with a lip opposing the spring.

14. The method of claim 13 wherein the step of placing the vent latch housing in the window jamb further comprises the step of rotating the vent latch housing to engage the window jamb opposing the spring with the lip.

15. The method of claim 14 further comprising the step of inserting the vent latch into the vent latch housing.

16. The method of claim 15 further comprising the step of affixing the housing in the window frame with a fastener.

17. The method of claim 16 further comprising the step of providing a second vent latch in a second vent latch sheath having a housing and a spring.

18. The method of claim 17 including the step of installing the second vent latch in the second vent latch sheath in the window frame opposite the first vent latch.

19. The method of claim 18 further comprising the step of aligning the respective vent latch sheaths by contacting them each with the window.

* * * * *